US009637208B1

(12) United States Patent
Alexander

(10) Patent No.: US 9,637,208 B1
(45) **Date of Patent: *May 2, 2017**

(54) FLOTATION-HYDRATION SYSTEM

(71) Applicant: Hydro Vest LLC, Miami, FL (US)

(72) Inventor: Ryan Alexander, Miami, FL (US)

(73) Assignee: Hydro Vest LLC, Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/171,125

(22) Filed: Jun. 2, 2016

Related U.S. Application Data

(63) Continuation of application No. 14/624,908, filed on Feb. 18, 2015, now Pat. No. 9,359,049.

(51) Int. Cl.

| | |
|---|---|
| ***B63C 9/115*** | (2006.01) |
| ***A41D 1/04*** | (2006.01) |
| ***A41D 13/012*** | (2006.01) |
| *B63C 9/00* | (2006.01) |

(52) U.S. Cl.
CPC ..... *B63C 9/115* (2013.01); *A41D 1/04* (2013.01); *A41D 13/0125* (2013.01); *A41D 2400/48* (2013.01); *B63C 2009/0094* (2013.01)

(58) Field of Classification Search
CPC ..... B63C 9/115; A41D 1/04; A41D 13/0125
See application file for complete search history.

(56) References Cited

U.S. PATENT DOCUMENTS

| | | | | |
|---|---|---|---|---|
| 6,314,579 | B1 | 11/2001 | Marcon | |
| 7,059,925 | B2 | 6/2006 | Smith et al. | |
| 7,552,734 | B2 | 6/2009 | Adams | |
| 8,357,020 | B2 * | 1/2013 | Hansbro | A45F 3/04 224/148.2 |
| 9,359,049 | B1 * | 6/2016 | Alexander | B63C 9/115 |
| 2006/0182372 | A1 | 8/2006 | Fadal, II et al. | |
| 2008/0038969 | A1 | 2/2008 | DeRiemer et al. | |
| 2012/0122358 | A1 | 5/2012 | Hansbro | |
| 2013/0344756 | A1 | 12/2013 | Day | |

* cited by examiner

*Primary Examiner* — Stephen Avila
(74) *Attorney, Agent, or Firm* — Malloy & Malloy, P.L.

(57) ABSTRACT

A flotation-hydration system to be worn by a user, particularly in a water borne environment, includes a vest assembly dimensioned to at least partially surround the user's upper torso while donned by the user in an operative manner. The vest assembly comprises a plurality of panels securely attached to one another, and a flotation assembly comprising at least one flotation member having a buoyant material of construction disposed in one of the panels of the vest assembly. A hydration support assembly is disposed substantially within the vest assembly and includes a chamber support unit, wherein the chamber support unit is dimensioned and configured to receive a hydration chamber in a supported relation therein. A dispensing tube is routed from the hydration chamber to the front of the vest assembly, for ready access by the user, through a dispensing tube retention channel.

10 Claims, 6 Drawing Sheets

FLOTATION-HYDRATION SYSTEM

BACKGROUND OF THE INVENTION

Field of the Invention

The present invention is directed to a flotation-hydration system including a vest assembly comprising a flotation assembly therein to provide required buoyancy, and a hydration assembly which is also disposed substantially within the vest assembly in a supported relation to provide for balance and to prevent entanglement of the hydration assembly as the user maneuvers about a watercraft or elsewhere.

Description of the Related Art

People of all ages enjoy a wide variety of water based recreational activities. These include boating, fishing, water skiing, etc. Furthermore, these activities are conducted in a wide variety of places ranging from small inland lakes to the open seas and oceans which surround us all. While pursuing many of these activities it is often recommended and in some instances required by regulation that certain or all persons don an approved personal flotation device while engaging in one or more of the above activities. As such, numerous personal flotation devices have been developed over the years, among the more common being a life preserver, or doughnut, and a personal flotation type vest, more commonly referred to as a life jacket.

As noted above, while conducting some of these activities, such as boating, fishing, water skiing, etc., it is recommended if not required that all persons wear a personal flotation device. It is also known that while conducting these activities, users are not always able to freely move about a water craft, for example, while commandeering the same, or while trolling, or even fishing while anchored. As such, it is not always convenient for people to maintain adequate hydration while engaged in these popular water activities.

As such, at least one device has been developed which provides for mounting a refillable hydration container onto the back of a standard life jacket and providing a tube to extend over a user's shoulder from the hydration container so that the user has a ready fluid supply at their disposal. Unfortunately, a hydration container and tube hanging off the back of a life jacket can easily become caught or entangled as a user maneuvers about the water craft. Further, simply strapping a hydration container to the back of a life jacket does not provide for a balanced distribution of the weight of the fluid within the hydration container, which can lead to imbalance of the user as he or she maneuvers about the water craft. As will be appreciated, loss of balance on a moving, or even stationary, water craft can be dangerous and can result in a used inadvertently falling overboard, possibly into the path of an oncoming craft.

A variation on the previously described device includes a hydration bladder strapped along a user's back while an inflatable flotation device is worn around the user neck and abdomen. As will be appreciated, the entanglement and balance issues are not resolved by virtue of having a front mounted inflatable flotation device and a hydration bladder mounted along a user's back.

As such, it would be beneficial to provide a combined flotation-hydration system wherein a hydration chamber is mounted within a flotation vest assembly such that the hydration chamber does not become entangled while a user is maneuvering about a water craft, or otherwise. It would be further beneficial to provide a flotation-hydration system having a hydration support assembly within a flotation vest assembly, wherein a hydration chamber is maintained in a supported and balanced orientation in the hydration support assembly in the back panel of the flotation vest assembly so as to assure an even distribution of the weight of the fluid in the hydration chamber, thereby providing balance for the user.

SUMMARY OF THE INVENTION

The present invention is directed to a flotation-hydration system to be worn by a user. In at least one embodiment, the system comprises a vest assembly dimensioned to at least partially surround the user's upper torso. The vest assembly includes a plurality of panels securely attached to one another, and in one embodiment, the panels are each constructed of corresponding ones of inner and outer panels.

A flotation assembly comprises at least one flotation member having a buoyant material of construction, and the at least one buoyant flotation member is disposed in one of the panels of the vest assembly. In one further embodiment, the flotation assembly comprises a plurality of buoyant flotation members each disposed within the panels of the vest assembly.

A hydration assembly includes a hydration chamber, and has a dispensing tube disposed in fluid communication with the hydration chamber. Furthermore, a hydration support assembly is disposed within one of the plurality of panels of the vest assembly, and in at least one embodiment, the hydration support assembly includes a chamber support unit. More in particular, the chamber support unit comprises a chamber support channel disposed at least partially therethrough, wherein the chamber support channel is dimensioned and configured to receive the hydration chamber substantially therein in a supported and balanced orientation.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 2:
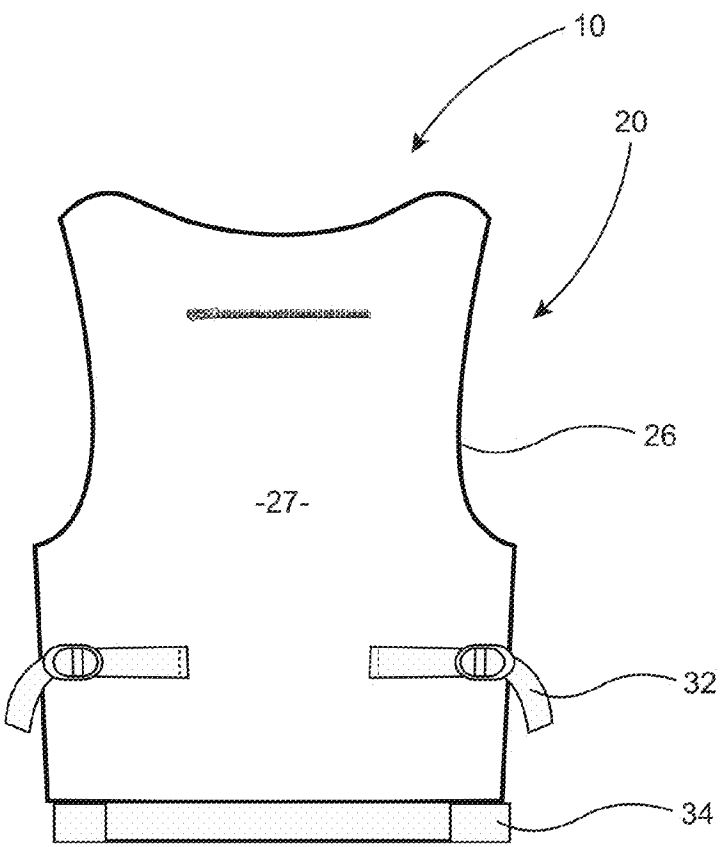
FIG. 2 is a rear elevation of the illustrative embodiment of the flotation-hydration system of FIG. 1.

As disclosed above, the present invention is directed to a flotation-hydration system as is generally shown throughout the figures as at 10. A flotation-hydration system 10 in accordance with at least one embodiment of the present invention includes a vest assembly such as is shown at 20 in the figures. The vest assembly 20 is configured and dimensioned to be worn in a substantially surrounding relation to the upper torso of a user. More in particular, in at least one embodiment, the vest assembly 20 is configured to substantially surround a user's back, chest, and abdomen, as will be appreciated from the figures.

A flotation-hydration system 10 in accordance with at least one further embodiment of the present invention includes a flotation assembly 40 having at least one flotation member 42, 44, 46, 48 comprised of a buoyant material of construction. Furthermore, a hydration assembly, such as is shown at 50 throughout the figures, is provided, and in at least one embodiment, the hydration assembly 50 is removably disposed within a portion of the vest assembly 20. More in particular, in at least one embodiment, a flotation-hydration system 10 in accordance with the present invention includes a hydration support assembly 60 disposed substantially within the vest assembly 20, wherein the hydration support assembly 60 is dimensioned to receive at least a portion of the hydration assembly 50 in a supported relation therein, once again, substantially within a vest assembly 20.

Figure 1:
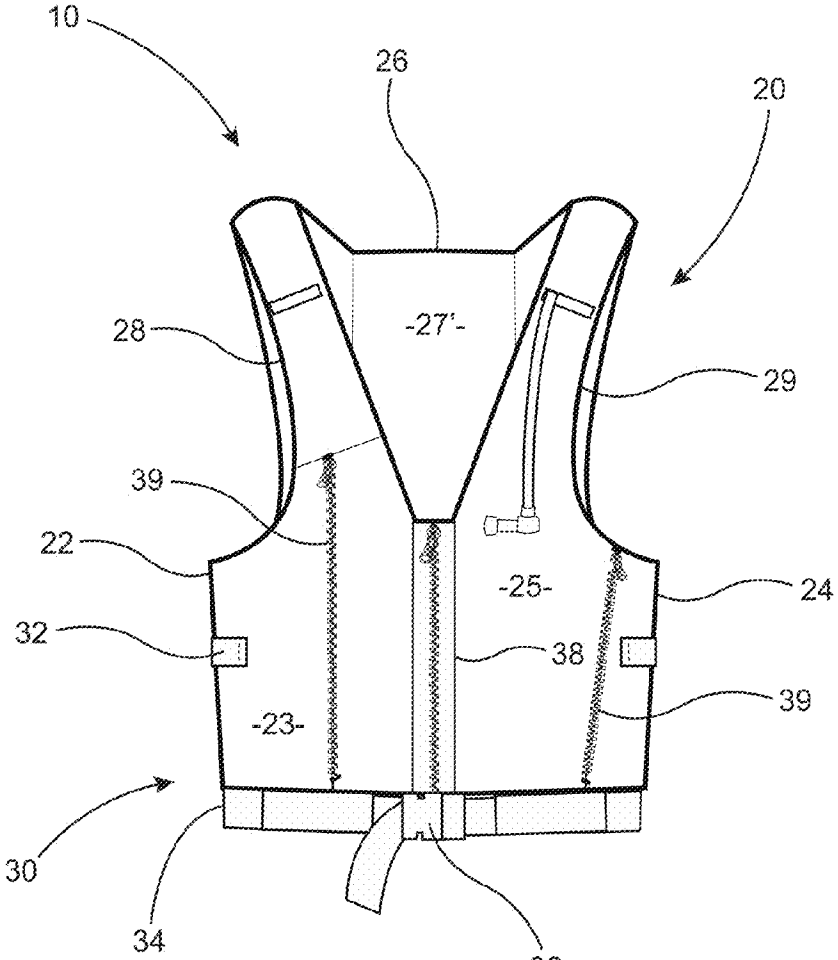
FIG. 1 is a front elevation of one illustrative embodiment of a flotation-hydration system in accordance with the present invention.
Figure 4:
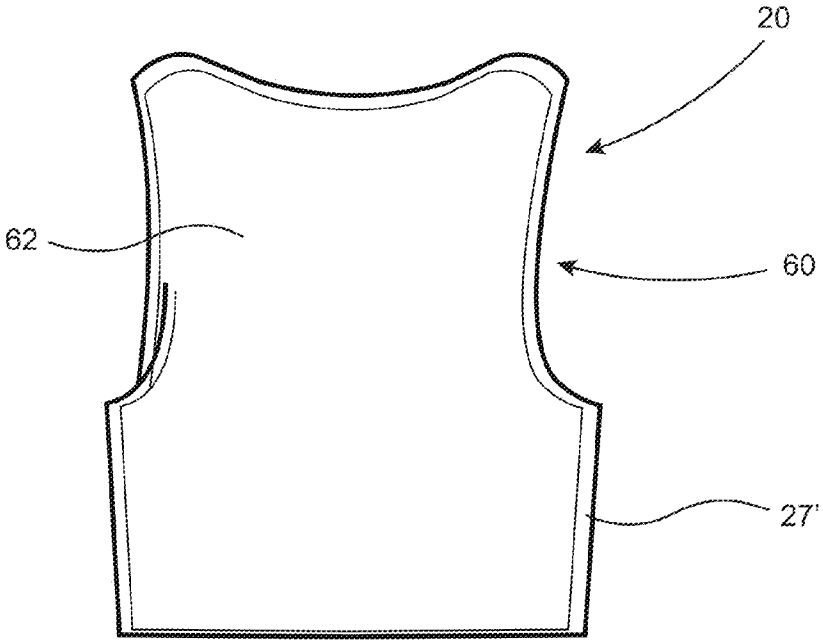
FIG. 4 is a partial cutaway rear elevation of the illustrative embodiment of the flotation-hydration system of FIG. 3.
Figure 3:
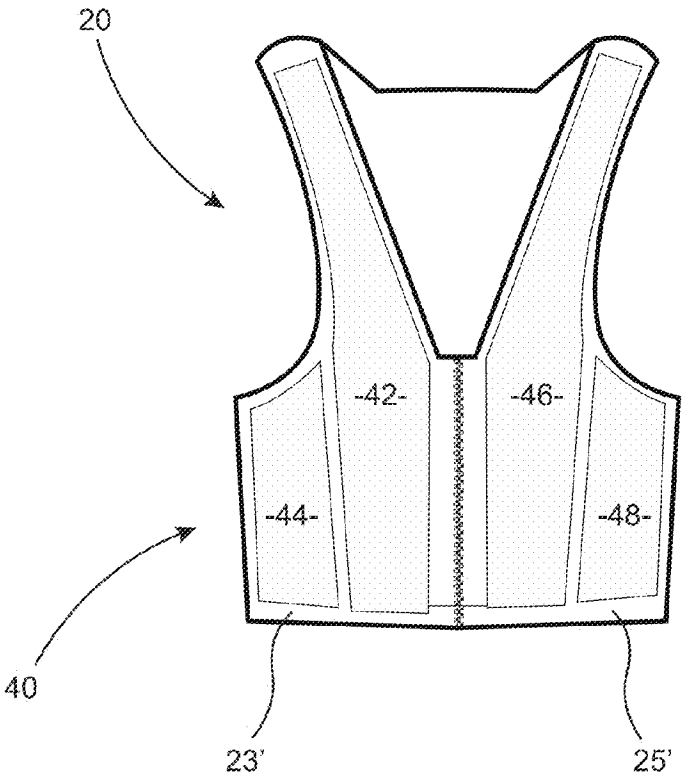
FIG. 3 is a partial cutaway front elevation of one further illustrative embodiment of a flotation-hydration system in accordance with the present invention.

Turning to the figures, we begin with reference to FIGS. 1 and 2, which present one illustrative embodiment of a flotation-hydration system 10 in accordance with the present invention. As may be seen from FIGS. 1 and 2, the vest assembly 20 includes a plurality of panels including right panel 22, left panel 24, and rear panel 26. In at least one embodiment, each of the plurality of panels 22, 24, 26 are securely interconnected to one another such as by sewing, stitching, adhesives, heat welding, etc. In at least one embodiment, each of the plurality of panels 22, 24, 26 are constructed from corresponding inner panels and outer panels. More in particular, and with reference to FIGS. 1 through 4, right panel 22 is constructed from right outer panel 23, as shown in FIG. 1, and right inner panel 23', as shown in FIG. 3. Similarly, left panel 24 is constructed of left outer panel 25, as shown in FIG. 1, and left inner panel 25', also shown in FIG. 3. Likewise, rear panel 26 is constructed of rear outer panel 27, as shown in FIG. 2, and rear inner panel 27', as is shown in FIG. 4.

It will be appreciated by these of skill in the art that the vest assembly 20, and more in particular, the panels 22, 24, 26 of the vest assembly 20 comprised of corresponding inner and outer panels can be constructed of any of a variety of materials suitable for use in a flotation device. In at least one embodiment, the panels 22, 24, 26 are constructed of a nylon fabric material of construction. In at least one further embodiment, outer panels 23, 25, 27 are constructed of a 400 Denier nylon fabric. In yet another embodiment, one or more of inner panels 23', 25', 27' are constructed of a 200 denier nylon fabric.

In at least one embodiment, a flotation assembly 40 in accordance with the resent invention comprises one or more flotation members, such as, by way of example, right flotation member 42, right side flotation member 44, left flotation member 46, and/or left side flotation member 48, disposed between corresponding ones of inner panels 23', 25', 27' and outer panels 23, 25, 27. Further, each flotation member 42, 44, 46, 48 comprises a buoyant material of construction such that the vest assembly 20 having one or more flotation members 42, 44, 46, 48 disposed therein will float when placed in a body of water. In at least one embodiment, a flotation assembly 40 comprises one or more flotation members 42, 44, 46, 48 dimensioned so as to support not just the weight of the vest assembly 20, but the weight of a user wearing the vest assembly 20 while the user is in a body of water.

In at least one embodiment, the flotation members 42, 44, 46, 48 in accordance with the present invention are constructed of an expanded polyethylene foam material. The expanded polyethylene foam is generally a semi-rigid closed cell type of foam which exhibits buoyant properties generally suited for personal flotation devices, such as incorporated in the present invention. More in particular, expended polyethylene foam is a semi-rigid foam product consisting of polyethylene and entrapped gas or gases. The expanded polyethylene foam in one embodiment has a density in a range of about 0.9 pounds per cubic foot to about 1.5 pounds per cubic foot. Further, in one embedment, the expanded polyethylene foam exhibits a buoyancy in a range of about 60 pounds per cubic foot to about 61 pounds per cubic foot.

In at least one further embodiment, flotation members 42, 44, 46, 48 comprise a thickness in the range of about one-half to two inches. More in particular, in one embodiment, each of right flotation member 42 and left flotation member 46 comprise a thickness of about two inches, while each of right side flotation member 44 and left side flotation member 48 comprise a thickness of about one and one-half inches.

Looking once again to FIG. 1, at least one embodiment of a flotation-hydration system 10 in accordance with the present invention includes an adjustment assembly 30 to allow users of various shapes and sizes to comfortably yet securely don the vest assembly 20 in an operative position substantially surrounding his or her upper torso. More in particular, an adjustment assembly 30 in accordance with one embodiment of the present invention includes at least one side adjustment member 32, and in one further embodiment, a side adjustment member 32 is provided on each of the right and left sides of the vest assembly 20. Furthermore, a waist adjustment member 34 is attached about the lower periphery of the vest assembly 20, once again, to allow a user to securely yet comfortably don the vest assembly 20 in an operative position. A waist closure mechanism 36 is provided which, along with a front closure mechanism 38, side adjustment member(s) 32, and waist adjustment member 34, facilitate comfortably securing the vest assembly 20 about the upper torso of a user. A comfortable fit is necessary to promote greater use of personal flotation devices.

With further reference to FIG. 1, in at least one embodiment, the vest assembly 20 of a flotation-hydration system 10 in accordance with the present invention includes one or more pockets disposed therein. Further, and as shown in FIG. 1, a pocket closure mechanism 39 is provided to prevent unintentional displacement of items placed in the pockets of the vest assembly 20 from falling out. As shown throughout the figures, front closure mechanism 38 and pocket closure mechanism 39 each comprise a zipper structure which, in at least one further embodiment, comprises a waterproof zipper structure. However, it will be appreciated by those of skill in the art that it is within the scope and intent of the present invention to utilize any of a variety of mechanical closure mechanisms in a vest assembly 20 of the present invention. As just one example, a closure mechanism may comprise a series or plurality of buttons, hook and loop type fasteners, laces, etc.

As previously disclosed above, a flotation-hydration system 10 in accordance with the present invention includes a hydration assembly 50 which is disposed substantially within a vest assembly 20 while deployed in an operative position, such as is shown in the illustrative embodiment of FIGS. 5 through 8. As may be seen from the illustrative embodiments of FIGS. 6 and 8, a hydration assembly 50 in accordance with at least one embodiment includes a hydration chamber 52. A hydration chamber 52 in at least one embodiment is constructed from a polymeric material which is suitable for containing and dispensing potable water. As will be appreciated by those skilled in the art, the hydration chamber 52 can comprise a fully collapsible bladder, a semi-flexible material of construction, or a substantially rigid material of construction. In at least one embodiment, a hydration chamber 52 in accordance with the present invention has a usable fluid capacity in range of between 50 and 100 fluid ounces, and in one further embodiment, a hydration chamber 52 has a usable fluid capacity of about 70 fluid ounces. As further shown in FIG. 6, a hydration chamber 52 includes a refill port 53 and a cap 54 structured to seal the same to prevent loss of fluid from the hydration chamber 52 while in use, in storage, or in transit.

Figure 8:
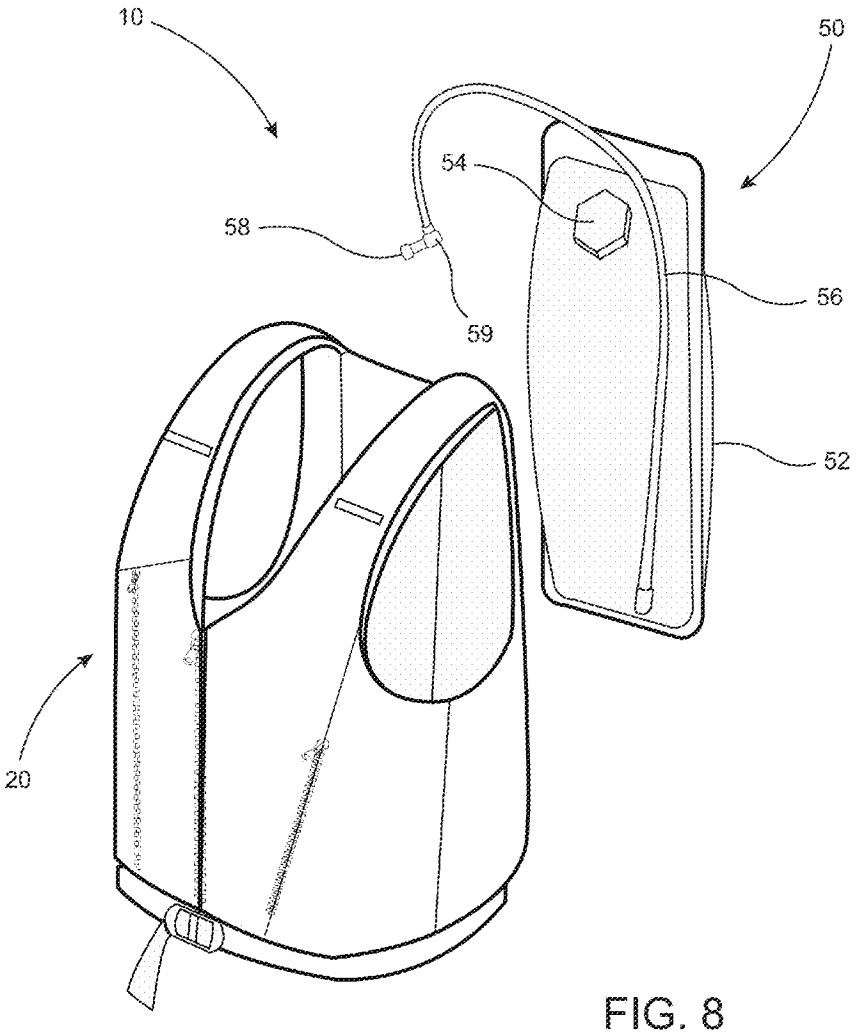
FIG. 8 is a partially exploded view, in perspective, of the illustrative embodiment of the flotation-hydration system of FIG. 1.

A dispensing tube 56 is disposed in fluid communication with a hydration chamber 52, and in at least one embodiment, such as is shown best in FIG. 8, the dispensing tube 56 is connected in fluid communication to a lower portion of hydration chamber 52. A mouthpiece 58 is provided at the opposite end of the dispensing tube 56 to facilitate a user drawing fluid through the hydration tube into his or her mouth and stomach. A dispensing valve 57 may be incorporated, in at least one embodiment of the present of the present invention, in order to prevent unintentional leakage of fluid from hydration chamber 52 out of mouthpiece 58, as well as to prevent the unintentional introduction of fluids, for example, lake or sea water, into hydration chamber 52 via dispensing tube 56.

Figure 9:
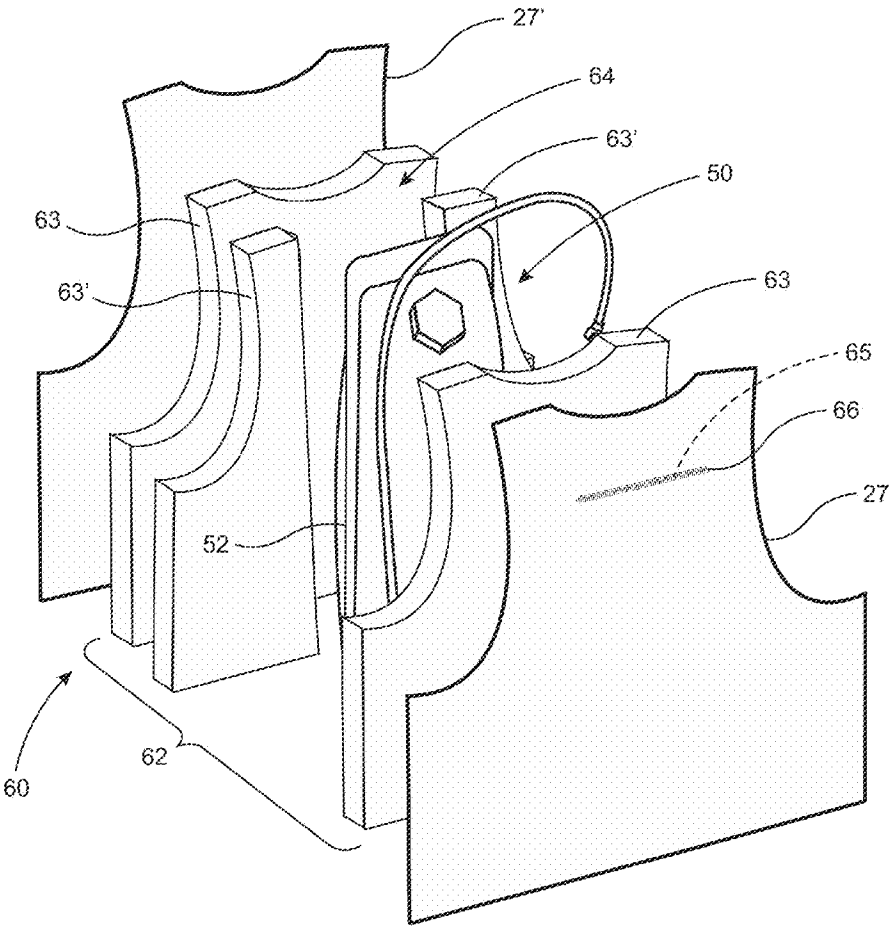
FIG. 9 is an exploded perspective view of one illustrative embodiment of a rear panel of a vest assembly, a hydration assembly, and a hydration support assembly of a flotation-hydration system in accordance with the present invention.

With reference to FIG. 9, at least one embodiment of a flotation-hydration system 10 in accordance with the present invention includes a hydration support assembly such as is shown as 60 in FIG. 9. More in particular, hydration support assembly 60, in at least one embodiment, includes a chamber support unit 62. A chamber support unit 62 is dimensioned to support a hydration assembly 50, and more in particular, a hydration chamber 52 thereof in a supported relation therein. More in particular, a chamber support unit 62 is dimensioned and configured to maintain the hydration chamber 52 of hydration assembly 50 in a substantially upright vertical orientation while the hydration chamber 52 is disposed in an operative supported relation in the chamber support unit 62.

As shown in the illustrative embodiment of FIG. 9, the chamber support unit 62 in accordance with one embodiment of the present invention comprises a plurality of support members 63, 63'. More in particular, and in accordance with the illustrative embodiment of FIG. 9, a chamber support unit 62 includes front and rear support members 63, as well as side support members 63' sandwiched there between. As will be appreciated from the exploded view of FIG. 9, when side support member 63' are sandwiched between front and rear support members 63, a chamber support channel 64 is formed there between. As will also be appreciated from the illustrative embodiment of FIG. 9, the chamber support channel 64 is dimensioned to receive and support the hydration chamber 52 in a supported orientation therein.

In at least one embodiment, the chamber support unit 62 comprises a buoyant material of construction. Once again, as with flotation members 42, 44, 46, 48, a chamber support unit 62 in accordance with at least one embodiment of the present invention may be constructed from an expanded polyethylene foam material. In an embodiment wherein a chamber support unit 62 comprises a plurality of support members 63, 63', one or more of the plurality of support members 63, 63' may comprise a buoyant material of construction, once again, by way of example, an expanded polyethylene foam material. As noted above, an expanded polyethylene foam is a semi-rigid material of construction such that a chamber support unit 62 formed of expanded polyethylene foam material comprises sufficient rigidity to support a hydration chamber 52 in a supported relation therein.

Looking once again to FIGS. 5 and 6, in at least one embodiment, a hydration support assembly 60 in accordance with the present invention includes at least one dispensing tube retainer 67. As shown in the illustrative embodiments of FIGS. 5 and 6, a dispensing tube retainer 67 extends from rear panel 26 along left shoulder strap 29 and terminates at a dispensing tube access opening 69 disposed on the front side of vest assembly 20. As shown best in FIG. 6, the dispensing tube retainer 67 forms a dispensing tube retention channel 68 which substantially surrounds dispensing tube 56 up to the point where the dispensing tube 56 exits dispensing tube access opening 69. As will be appreciated by those of skill in the art, the dispensing tube retainer 67 serves to substantially prevent entanglement of dispensing tube 56 while the flotation-hydration system 10 in accordance with the present invention is being worn by a user.

Figure 6:
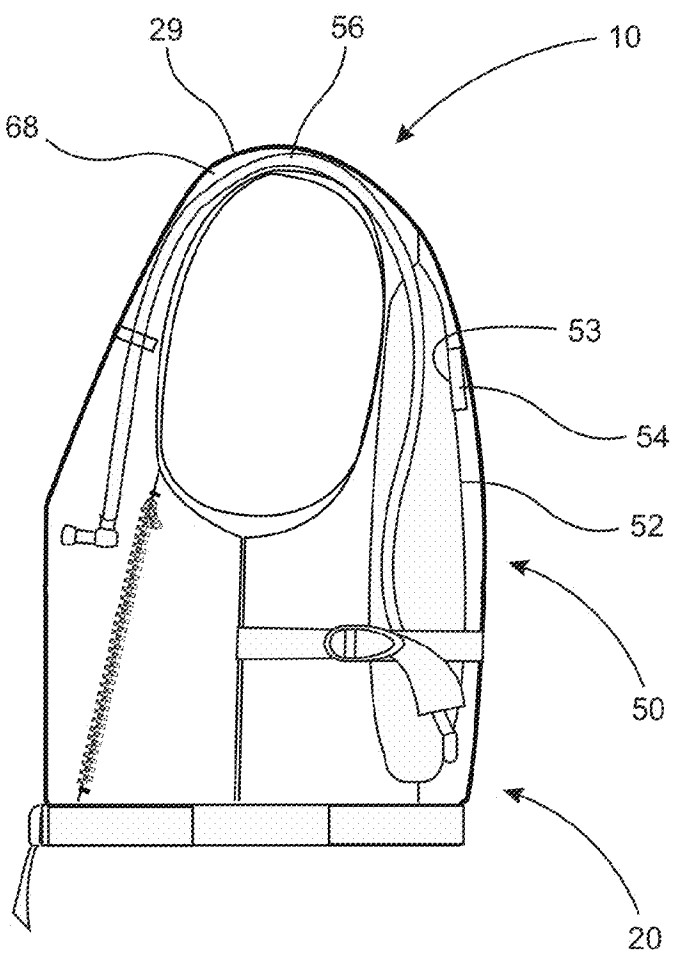
FIG. 6 is a partial cutaway view of the illustrative embodiment of the flotation-hydration system of FIG. 5.
Figure 5:
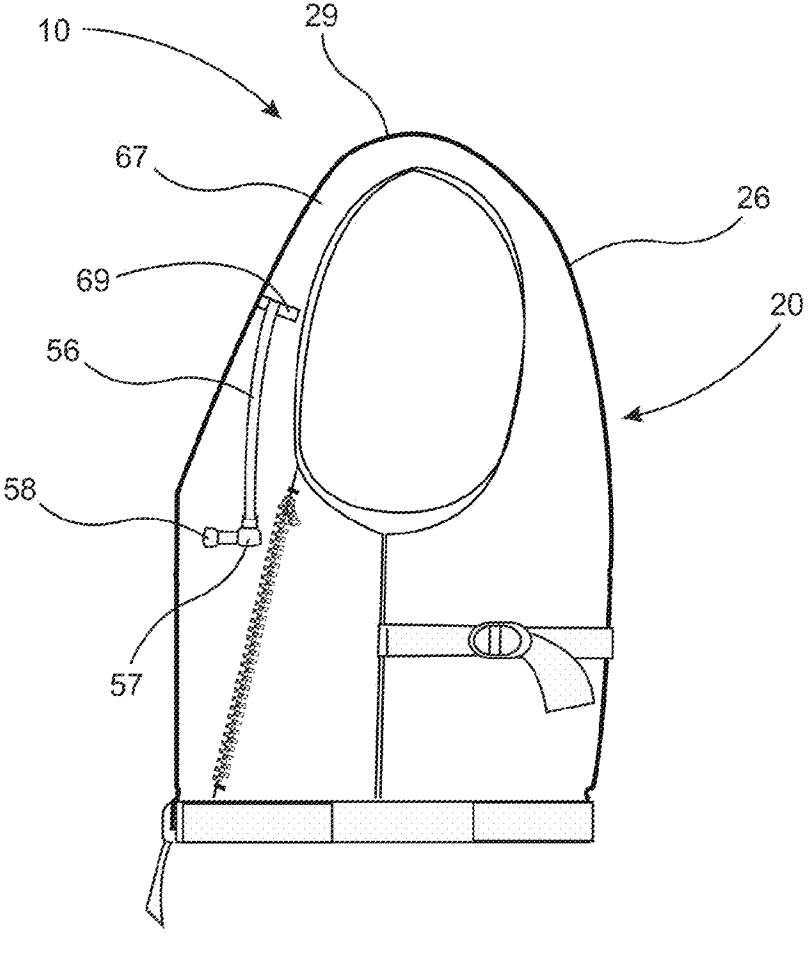
FIG. 5 is a left side elevation of the illustrative embodiment of the flotation-hydration system of FIG. 1.
Figure 7:
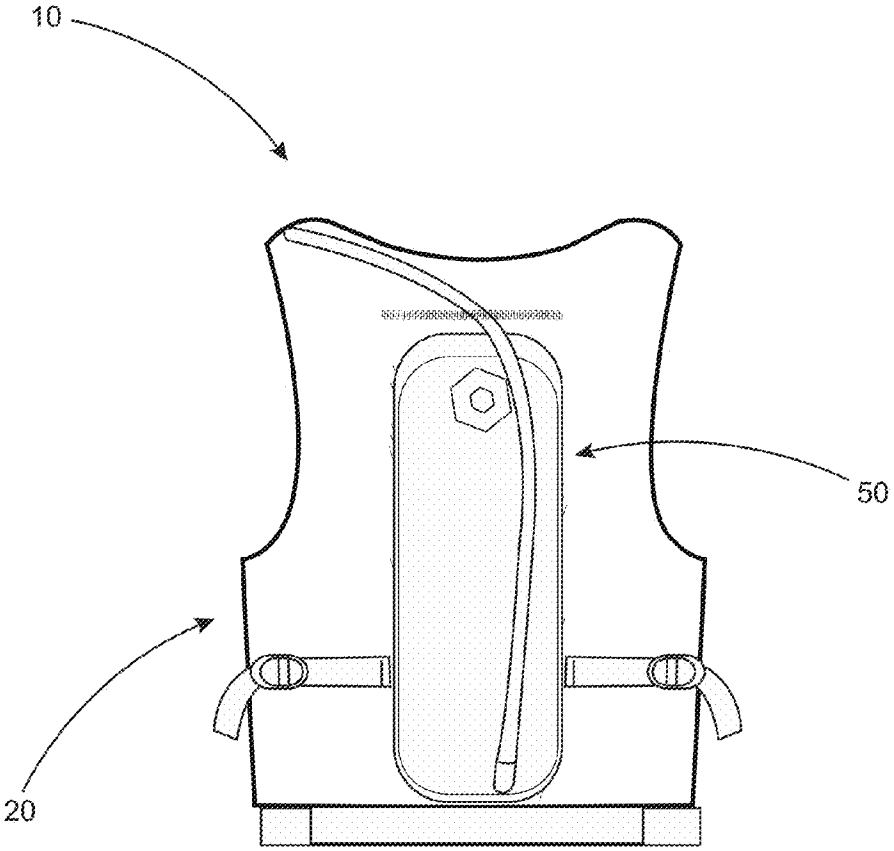
FIG. 7 is partial cutaway rear elevation of the illustrative embodiment of the flotation-hydration system of FIG. 1.

As will be further appreciated from the illustrative embodiments of FIGS. 5 and 6, the present flotation-hydration system 10 having a hydration assembly 50, and more specifically, a hydration chamber 52 disposed in a supported relation in a chamber support unit 62 which is mounted within a vest assembly 20, allows a user freedom of movement without fear of entanglement of the hydration chamber 52 while wearing a flotation-hydration system 10 in accordance with the present invention. Further, by maintaining the hydration chamber 52 in a supported orientation in a chamber support channel 64, a chamber support unit 62 serves to evenly distribute and balance the weight of the fluid within hydration chamber 52 along and across a user's back while he or she is wearing a flotation-hydration system 10 in accordance with the present invention.

A channel access opening 65 is provided through rear outer panel 27 and is disposed in alignment with chamber support channel 64. More in particular, the channel access opening 65 is provided to facilitate placement of hydration chamber 52 into and out of chamber support channel 64. In at least one embodiment, a closure mechanism 66 is provided along channel access opening 65 in order to prevent unintentional displacement of hydration chamber 52 from a chamber support unit 62.

Since many modifications, variations and changes in detail can be made to the described embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A flotation-hydration system to be worn by a user, said system comprising:

a vest assembly dimensioned to at least partially surround the user's upper torso, wherein said vest assembly comprises a right shoulder strap and a left shoulder strap, a flotation assembly comprising at least one flotation member disposed within said vest assembly, wherein said at least one flotation member comprises a buoyant material of construction, a hydration assembly comprising a hydration chamber having a dispensing tube disposed in fluid communication therewith, a hydration support assembly disposed within said vest assembly, wherein said hydration support assembly includes a chamber support unit, said hydration support assembly further comprises at least one dispensing tube retainer, wherein said at least one dispensing tube retainer is attached to one of said right shoulder strap or said left shoulder strap, said at least one dispensing tube retainer forming a dispensing tube retention channel extending from said hydration chamber along said right shoulder strap or along said left shoulder strap to a dispensing tube access opening, said dispensing tube retention channel substantially surrounding said dispensing tube from said hydration chamber to said dispensing tube opening to prevent entanglement of said dispensing tube while the flotation-hydration system is being worn by the user, and said chamber support unit comprises a chamber support channel disposed at least partially therethrough, wherein said chamber support channel is dimensioned to receive said hydration chamber substantially therein in a supported and balanced orientation.

2. The system as recited in claim 1 wherein said hydration support assembly comprises a plurality of dispensing tube retainers, wherein at least one of said plurality of said dispensing tube retainers is attached to said right shoulder strap and at least one other of said plurality of said dispensing tube retainers is attached to said left shoulder strap.

3. The system as recited in claim 2 wherein each of said plurality of dispensing tube retainers forms a dispensing tube retention channel extending from said hydration chamber along one of said right shoulder strap or said left shoulder strap to a corresponding dispensing tube access opening, each said dispensing tube retention channel dimensioned to substantially surround said dispensing tube from said hydration chamber to said corresponding one of said dispensing tube openings to prevent entanglement of said dispensing tube while the flotation-hydration system is being worn by the user.

4. A flotation-hydration system to be worn by a user, said system comprising:

a vest assembly dimensioned to at least partially surround the user's upper torso, said vest assembly comprising a right shoulder strap and a left shoulder strap, a flotation assembly comprising a plurality of flotation members disposed within said vest assembly, wherein each of said plurality of flotation members comprises a buoyant material of construction, a hydration assembly comprising a hydration chamber having a dispensing tube disposed in fluid communication therewith, a hydration support assembly disposed within said vest assembly, said hydration support assembly including a chamber support unit, said hydration support assembly further comprising at least one dispensing tube retainer attached to one of said right shoulder strap or said left shoulder strap, wherein said dispensing tube retainer forms a dispensing tube retention channel extending from said hydration chamber along said right shoulder strap or said left shoulder strap to a dispensing tube access opening, and said chamber support unit comprises a chamber support channel disposed at least partially therethrough, wherein said chamber support channel is dimensioned to receive said hydration chamber substantially therein in a supported and balanced orientation.

5. The system as recited in claim 4 wherein said dispensing tube retention channel substantially surrounds said dispensing tube from said hydration chamber to said dispensing tube opening to prevent entanglement of said dispensing tube while the flotation-hydration system is being worn by the user.

6. The system as recited in claim 4 wherein said chamber support unit comprises a rigid material of construction.

7. The system as recited in claim 4 wherein said chamber support unit comprises a buoyant material of construction.

8. The system as recited in claim 4 wherein said chamber support unit comprises a plurality of chamber support members cooperatively arranged to form said chamber support channel therebetween, wherein at least some of said plurality of chamber support members comprise a rigid material of construction.

9. The system as recited in claim 4 wherein said chamber support unit comprises a plurality of chamber support members cooperatively arranged to form said chamber support channel therebetween, wherein at least some of said plurality of chamber support members comprise a buoyant material of construction.

10. The system as recited in claim 4 wherein said chamber support unit comprises a plurality of chamber support members cooperatively arranged to form said chamber support channel therebetween, wherein at least some of said plurality of chamber support members comprise a rigid and buoyant material of construction.

* * * * *